United States Patent [19]

McDonald

[11] 4,174,061

[45] Nov. 13, 1979

[54] PORTABLE APPARATUS FOR FABRICATING WOODEN TRUSSES

[76] Inventor: William D. McDonald, Rte. 1, Box 322C, Monroe, Oreg. 97456

[21] Appl. No.: 913,247

[22] Filed: Jun. 6, 1978

[51] Int. Cl.[2] ..... B25C 7/00

[52] U.S. Cl. ..... 227/152; 100/DIG. 13; 144/288 C; 269/321 F

[58] Field of Search ..... 29/281.3; 100/231, DIG. 13; 144/288 C; 227/152; 269/321 F

[56] References Cited

U.S. PATENT DOCUMENTS

| | | | |
|---|---|---|---|
| 3,487,430 | 12/1969 | Schmitt | 100/DIG. 13 |
| 3,711,007 | 1/1973 | Fry | 227/152 X |
| 3,752,467 | 8/1973 | Stanley | 269/321 F |
| 3,896,717 | 7/1975 | Schmitt | 100/DIG. 13 |
| 3,941,291 | 3/1976 | Hayworth | 227/152 |

*Primary Examiner*—Paul A. Bell
*Attorney, Agent, or Firm*—D. Paul Weaver

[57] ABSTRACT

A portable truss fabricating apparatus in the nature of a trailer enables convenient and expeditious manufacturing of wooden trusses on the job site. The use of dual articulated and counterbalanced booms on an elevated support structure of the apparatus with a conventional hydraulic C-clamp suspended by a cable from one boom places any joint on the truss in easy reach of the operator without shifting the truss lumber, and giving the operator complete freedom of movement without the burden of carrying the hydraulic C-clamp. The truss supporting bed of the apparatus includes both longitudinal and transverse extension members which are retracted during transport. Means to safely stow the dual boom structure and to stabilize the long support bed during transport are also provided.

13 Claims, 7 Drawing Figures

53
52
55
54
5.
43
42
39
55
40
50
51
41
37
56
35
41
28
58
23
27
21
58
20
20
21
27
23

53
52
54
6.
39
50
58
37
60
6.
58
59
28
21
27
20
20
40
51
27
24
25
26

FIG.5
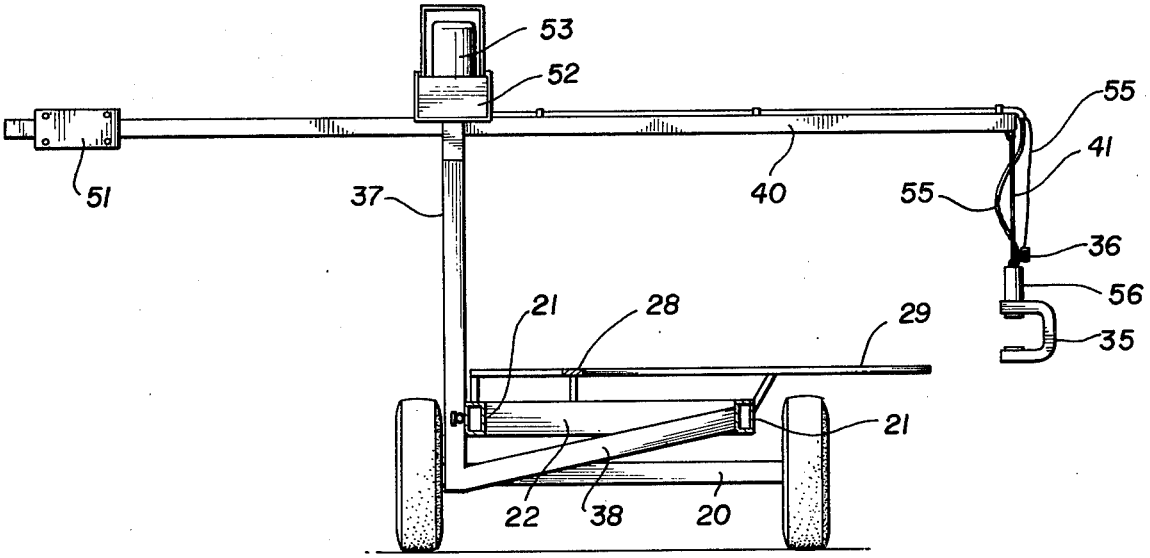
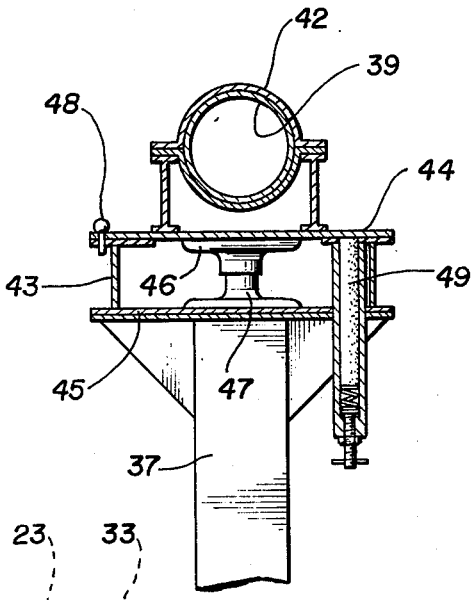
FIG.6
FIG.7
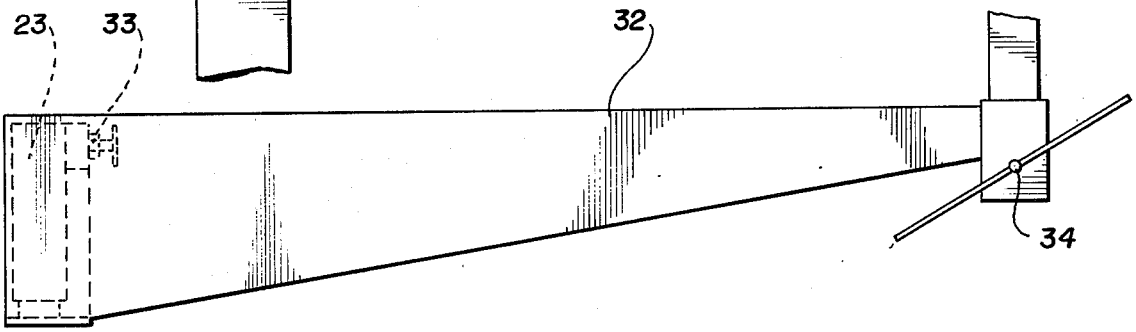

PORTABLE APPARATUS FOR FABRICATING WOODEN TRUSSES

BACKGROUND OF THE INVENTION

The wide usage of fabricated roof trusses in recent times and the ever-increasing size of these trusses has led to the need for on-the-job-site apparatuses for fabricating the trusses so that they do not have to be transported over roadways. To satisfy this need, certain fixed and portable wooden truss fabricating plants have been proposed in the prior art. To comply with the duty to disclose known prior art under 37 C.F.R. 1.56, the below-listed prior United States patents are made of record herein: U.S. Pat. Nos. 3,068,483; 3,379,354; 3,693,542; 3,752,467; 3,933,348; 4,071,061.

Generally speaking, the prior art proposals pertaining to apparatuses for fabricating wooden trusses on the job site have not proven entirely practical because of undue complication and cost of the mechanisms. Additionally, where the customary hydraulically operated C-clamp for applying nailing clips to truss joints is tethered on the apparatus as in U.S. Pat. No. 3,379,354, there is insufficient freedom of movement of the clamp relative to the work, in some cases requiring shifting of the truss lumber on the support bed of the apparatus in the course of the fabricating process.

To overcome these and other difficulties of the prior art, the present invention is embodied in a more simplified and much more versatile portable truss fabricating apparatus which basically comprises a transport trailer having a bed for the support of truss lumber in a convenient and secure manner on the job site. The trailer bed has longitudinal and transverse truss lumber supporting members, some of which are readily extendable on the job site so that the complete truss framework can be supported. The extendable support members of the trailer bed can be retracted or removed during transport of the apparatus behind a towing vehicle. Adjustable outrigger jacks are provided on the trailer bed to level and stabilize the bed during usage.

A dominant feature of the invention resides in the provision at one side of the trailer bed of an upright support for a double articulated boom arrangement which supports the hydraulically operated C-clamp in suspended relationship to an auxiliary counterweighted boom which in turn is suspended for universal movement from the main boom swiveled to the top of the side upright support. The operator of the clamp for placing the nailing clips at the truss joints is freed from the task of carrying the heavy clamp and the operator has almost complete freedom of movement over the entire truss area so that all joints can be secured with the clamp without the necessity for shifting the lumber. This is the main improvement feature of the invention which distinguishes it from the prior art.

Other features and advantages of the invention will appear during the course of the following detailed description.

BRIEF DESCRIPTION OF THE DRAWINGS

FIG. 5 is a transverse vertical section taken on line 5—5 of FIG. 3.

FIG. 6 is an enlarged fragmentary vertical section taken on line 6—6 of FIG. 4, partly in elevation.

FIG. 7 is a side elevational view of a stabilizing brace employed between bed extension members to stabilize them during the use of the apparatus.

DETAILED DESCRIPTION

Figure 1:
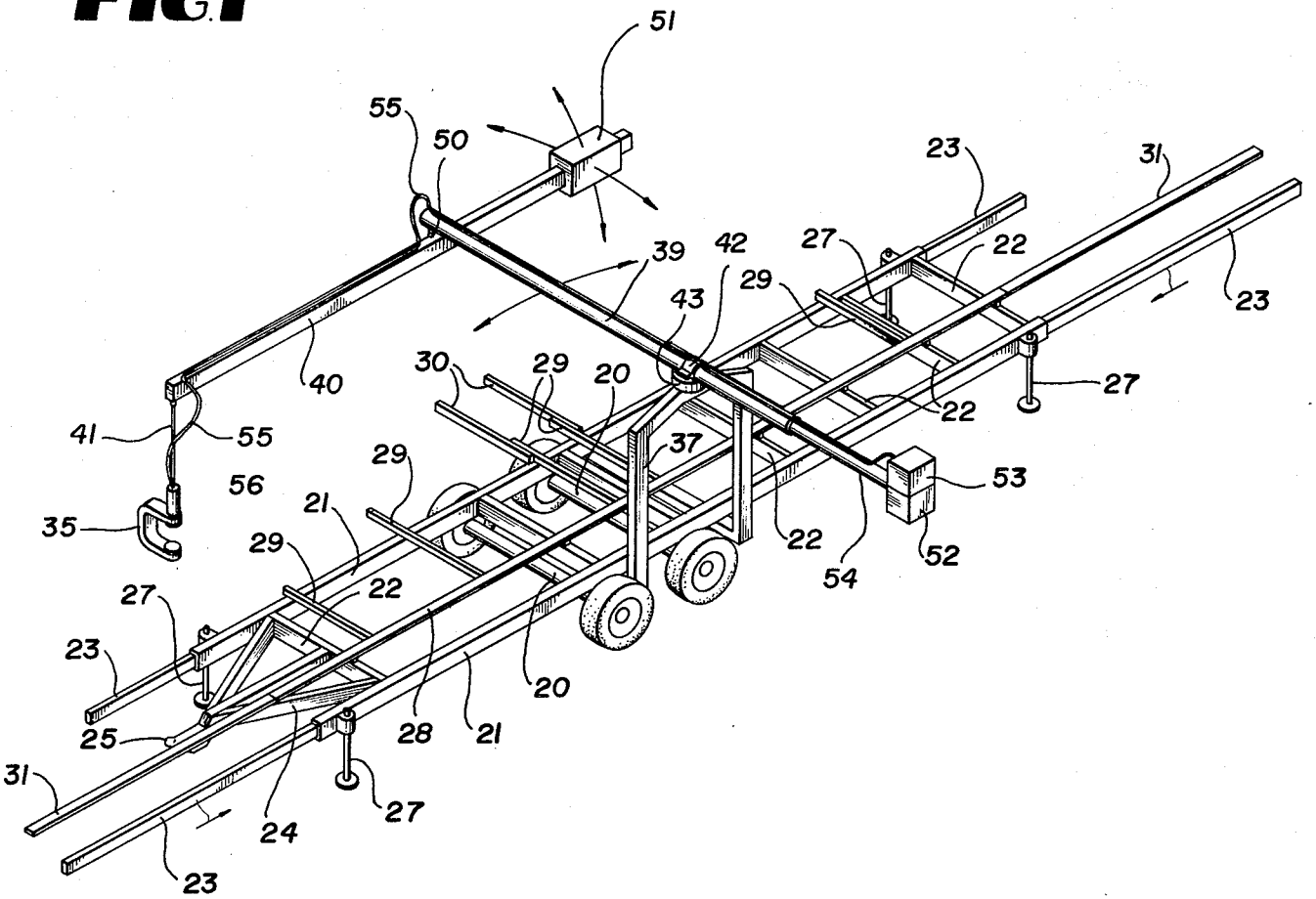
FIG. 1 is a perspective view of a portable apparatus for fabricating trusses as the apparatus would appear ready for use on a job site.

Referring to the drawings in detail, wherein like numerals designate like parts, a portable wooden truss fabricating apparatus comprises an elongated comparatively low level trailer bed mounted on a pair of mobile home type axles 20 and including main longitudinal parallel side rails 21 rigidly interconnected by transverse brace bars 22 at spaced intervals. The main longitudinal side rails 21 have end telescoping extension bars 23 to assist in supporting truss lumber during the fabrication of a wooden truss on the job site, FIG. 2, as will be further discussed. The extension bars 23 are retracted into the main side rails 21 during transport of the apparatus on a roadway, FIG. 4. At its forward end, the trailer bed has a draft tongue 24 rigid therewith including a depressed hitch 25 adapted to be coupled to the drawbar 26, FIG. 4, of a suitable towing vehicle. For the purpose of leveling and stabilizing the trailer bed on the job site, four corner vertically extensible and retractable jack devices 27 of a conventional type are provided on the trailer bed. These jacks are elevated during transport of the apparatus, FIG. 4.

Figure 2:
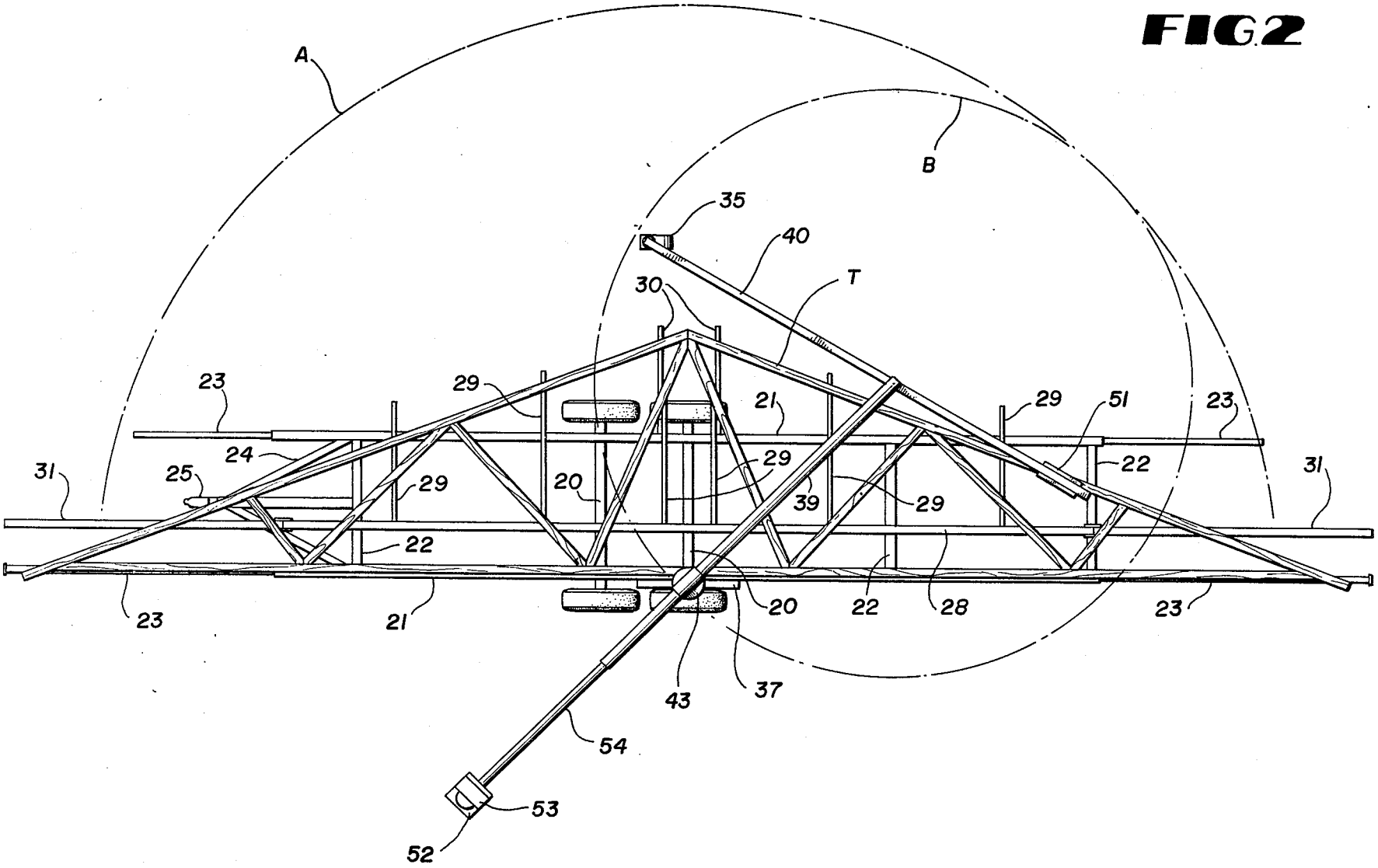
FIG. 2 is a plan view of the apparatus with truss lumber resting thereon, parts omitted.

The truss lumber supporting means of the apparatus further comprises a longitudinal support rail 28 inwardly of and parallel to one main rail 21 and rigidly attached to the several cross braces 22. The rail 28 is somewhat off-center on the trailer bed as indicated in FIG. 2. In cooperation with the longitudinal lumber support rail 28, a plurality of transverse horizontal support bars 29 are secured to the rail 28 at right angles thereto and extend toward and beyond the far main rail 21. The several transverse bars 29 are spaced apart at wide intervals along the length of the trailer bed to provide the necessary truss lumber supporting surface in a single horizontal plane. At least the two support bars 29 near the longitudinal center of the trailer bed have extension sections 30 which are rigidly coupled thereto on the job site by any conventional attaching means, not shown. Similarly, to accommodate the largest possible sizes of wooden trusses on the apparatus, opposite end extension bars 31 are also provided on the support rail 28 and are detachably secured to the latter on the job site by conventional means.

The rather long extension bars 31 when employed can be braced near their outer ends to the main frame extensions 23 by a bracket arm 32 shown in FIG. 7 but omitted from the drawings in FIGS. 1 and 2 for simplicity. The bracket arm 32 has one end clamping means 33 to attach the bracket arm removably to one of the extension bars 23 and an opposite end clamping means 34 for attaching the bracket arm removably to one of the adjacent bars 31. The use of the bracket arm 32 adds strength and rigidity to the supporting bed for the truss lumber which is illustrated in FIG. 2 by the general reference symbol T. It can be noted in FIG. 2 that the trailer bed can stably support all of the lumber components for a substantial size truss so that the customary nailing plates can be pressed into bridging relationship with all of the butt joints between truss components throughout the structure by operation of a conventional hydraulically operated manually controlled C-clamp or press 35, to be further described.

A most important feature of the invention is embodied in the supporting means for the clamp or press 35 which sets the nailing plates, not shown, simultaneously into opposite sides of the truss framework at the joints between the lumber components. The hydraulically operated clamp or press 35 may be of the type manufactured and sold by The Panel Clip Co., P.O. Box 423, Farmington, Mich. 48024 under the trademark KLINCHER. Such a conventional press is also disclosed in U.S. Pat. No. 3,379,354. Since the press 35 per se is well known, its details of construction need not be fully described herein. Suffice it to say that an operator manipulates the suspended C-frame of the press 35 into straddling engagement with each truss joint and by operating a control button 36 on the press 35 causes the press jaws to simultaneously force nailing plates or clips into opposite sides of each truss joint throughout the structure until the fabrication of the truss T is completed. This general mode of operation is well known in the art.

The improved supporting means for the clamp or press 35 which is the essence of the invention comprises an upright fixed support frame 37 on one side of the trailer bed near the longitudinal center thereof and suitably anchored to one main rail 21 and further supported at its lower end, FIG. 5, by a rigid inclined brace 38 secured to the far side rail 21. The upright frame 37 extends for a considerable elevation above the low trailer bed and forms a support for a main boom 39 and an articulated secondary boom 40 carried by the main boom and supporting the clamp or press 35 through a suspension cable 41 attached to one end of the secondary boom 40.

More particularly, the main boom 39 is free to turn horizontally through a full 360 degrees at the top of the support frame 37. The main boom 39, which is tubular, FIG. 6, is clamped by a saddle structure 42 to a swivel 43 atop the support frame 37 consisting of an upper rotational plate 44 and a lower fixed plate 45 rigidly secured to the top of the frame 37. A vertical axis spindle for the swivel includes an upper section 46 secured to the rotational plate 44 and a lower section 47 secured to the fixed plate 45. During highway transport, the vertical axis swivel is immobilized by a locking pin 48. This pin is removed during the use of the apparatus on the job site so that the main boom 39 may swing freely horizontally, as described. An adjustable friction braking device 49 in contact with the rotational plate 44 is provided so that a desirable drag on the main boom 39 can be established by the operator for smoothness and convenience of operation and to prevent overtravel of the main boom on its vertical axis of rotation.

The secondary boom 40 is suspended from the leading end of the main boom 39 by a suspension swivel 50 whereby the secondary boom may swing up and down vertically with the press 35 to any necessary elevation and may also turn horizontally around the axis of the swivel 50 for a full 360 degrees. This ability of the two booms 39 and 40 to rotate independently horizontally for a full 360 degrees plus the vertical swingability of the secondary boom 40 is the essence of the invention which enables the operator, who is manipulating the hydraulic press 35, to have complete freedom of movement with the press over the full span of the truss T, FIG. 2, so that all of its joints can be efficiently connected by nailing plates without shifting any of the truss lumber during the operation. There is no need for the operator to strain or over-reach with the press 35 and the entire truss fabricating procedure is rendered much more facile than in the prior art arrangements.

For further convenience and ease of operation, the secondary boom 40 carries an adjustable counterweight 51 near its rear end and on the side of the main boom 39 away from the press 35. Similarly, the main boom 39 is adjustably counterweighted by a hydraulic reservoir 52 and pump module 53 mounted on its rear end away from the secondary boom 40 through a telescoping section 54 of the main boom which permits counterweight adjustment. A hydraulic hose 55 extends from the pump module 53 along the two booms 39 and 40 and is connected to the hydraulic operating means 56 of the press 35 in a conventional manner. The hydraulic system including the pump is electrically controlled conventionally and an electrical cable 57, FIG. 5, extends from the actuator button 36 along the two booms and may descend through the swivel 43 on the support frame 37 to a source of power, not shown. All of the hydraulic and electrical control means are conventional.

The two booms 39 and 40, which are counterweighted as described, are of such lengths and extend sufficiently beyond their swivels 43 and 50 to enable the clamp or press 35 to sweep through a major arc A, FIG. 2, centered on the vertical axis swivel 43 for the main boom which spans the full extent of the truss T from end-to-end. Additionally, the press 35 can travel a full 360 degrees on a secondary arc B, FIG. 2, whereby the press can be guided by the operator into engagement with every butt joint of the truss without moving any of the truss lumber. This mode of operation and the efficiency resulting therefrom is not achieved with any of the prior art systems, either fixed or portable, and is the main feature of this invention, as stated.

Figure 3:
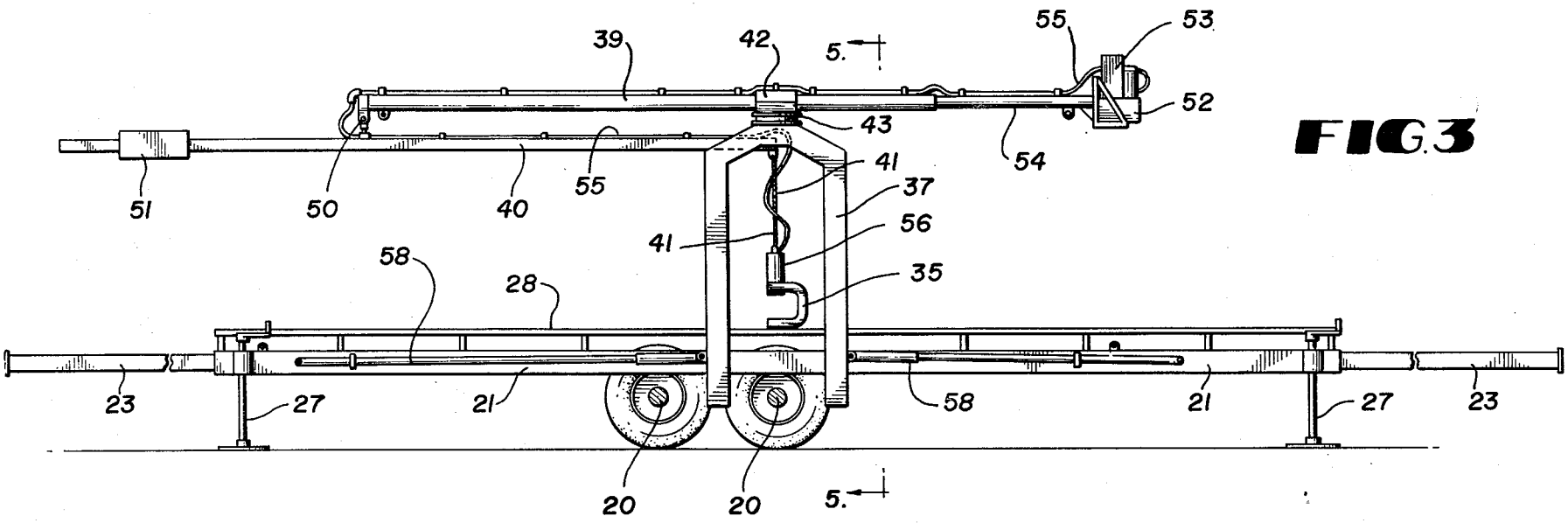
FIG. 3 is a side elevational view of the apparatus in its use position.
Figure 4:
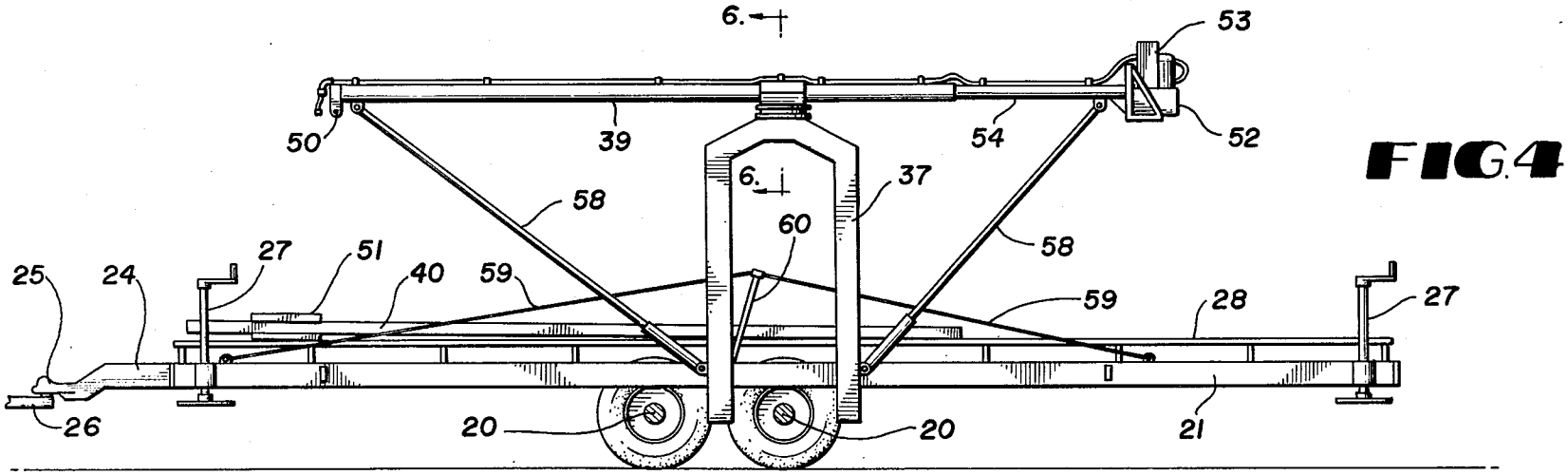
FIG. 4 is another side elevation of the apparatus in its transport mode.

With particular reference to FIG. 4, the apparatus is shown in condition for highway transport behind a towing vehicle. The jack devices 27 are retracted well above ground level. The secondary boom 40 is separated from the primary boom 39 and placed horizontally on the trailer bed to which it may be lashed or clamped. The hydraulic clamp or press 35 is also preferably separated and securely stowed on the trailer bed or elsewhere. The various extension members 23, 30 and 31 are either fully retracted or separated and placed on the trailer bed which may have a partial plywood bottom, not shown, for supporting parts. The main boom 39 is swung to extend parallel to the line of travel of the trailer bed and is locked in this position by a pair of fore and aft longitudinally adjustable inclined braces 58. When the apparatus is in use for lubricating trusses, FIG. 3, the two braces 58 are lowered to horizontal positions below the level of the truss lumber and supporting members.

To further stabilize the apparatus during transport, fore and aft guy cables 59 are anchored to the trailer bed near its opposite ends and are tensioned by a center prop 60 which may be swung down to an out of the way position during the normal use of the apparatus.

Many conventional details in the apparatus are purposely omitted in the drawings for simplicity of illustration and because such conventional details are not a part of the inventive subject matter. The drawing illustration attempts to illustrate and highlight those components which are the heart of the invention, as described. For example, in FIG. 2, temporary clamps are used to hold the truss lumber in place on the trailer bed and these are not illustrated.

The important features and advantages of the invention over the prior art should now be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A portable apparatus for fabricating wooden trusses comprising a wheeled bed adapted to be towed and having a truss lumber supporting surface means, an upright support frame rising from one side of the bed near the longitudinal center of the bed, a main horizontally rotatable boom swiveled on the top of the upright supporting frame, a secondary boom carried by the main boom and being vertically swingable and horizontally rotatable relative to and independently of the main boom and being supported by the main boom at an elevation substantially above said bed, and a manually guided power clamping device suspended from the secondary boom and being operable to press nailing plates into opposite sides of lumber joints of a wooden truss being fabricated by the apparatus.

2. A portable apparatus for fabricating wooden trusses as defined in claim 1, and said secondary boom being suspended beneath one end of the main boom by an universal coupling, and load counterbalancing means on the main and secondary booms.

3. A portable apparatus for fabricating wooden trusses as defined in claim 2, and an adjustable tension friction element engaging a swivel element of the main boom to establish a predetermined friction drag on the rotation of the main boom.

4. A portable apparatus for fabricating wooden trusses as defined in claim 2, and said power clamping device being a hydraulically operated device, and the counterbalancing means on the main boom comprising hydraulic reservoir and pump modules attached thereto, the counterbalancing means on the secondary boom comprising an adjustable counterweight.

5. A portable apparatus for fabricating wooden trusses as defined in claim 1, and said truss lumber supporting surface means of said bed comprising plural longitudinal and transversely extending lumber support bars on said bed at a common elevation.

6. A portable apparatus for fabricating wooden trusses as defined in claim 5, and longitudinal and transverse extension members on at least some of said bars forming the truss lumber supporting surface means, whereby wooden trusses of varying sizes can be fabricated by said apparatus.

7. A portable apparatus for fabricating wooden trusses as defined in claim 1, and a vertical axis swivel on the top of the upright support frame and having a lower part rigid with the top of the upright supporting frame and an upper rotational part, and a saddle structure on the upper rotational part of said swivel clampingly engaging and supporting said main boom between the ends thereof.

8. A portable apparatus for fabricating wooden trusses as defined in claim 7, and said main boom having a telescopically extensible and retractable section at its end away from the secondary boom, and a counterweight on said telescopically extensible and retractable section.

9. A portable apparatus for fabricating wooden trusses as defined in claim 1, and a flexible suspension element for said power clamping device dependingly secured to one end portion of the secondary boom and supporting said clamping device at an elevation near and above said truss lumber supporting surface means when the secondary boom is horizontally disposed.

10. A portable apparatus for fabricating wooden trusses as defined in claim 1, and a pair of adjustable braces on said wheeled bed adapted for connection with said main boom to rigidly secure the main boom in a horizontal position longitudinally of the wheeled bed during transport on a roadway.

11. A portable apparatus for fabricating wooden trusses as defined in claim 10, and the secondary boom being separably connected to the main boom whereby the secondary boom may be rested on the wheeled bed during transport, and erectable and collapsible guy means on the wheeled bed to steady and reinforce the wheeled bed during transport.

12. A portable apparatus for fabricating wooden trusses as defined in claim 1, and said wheeled bed being a comparatively narrow and elongated bed having transport axle means near its longitudinal center, and extensible and retractable jack devices on the fore and aft corners of the wheeled bed to level and stabilize said bed at a job site.

13. A portable apparatus for fabricating wooden trusses as defined in claim 1, and the lengths of the main and secondary booms and their placement on the upright supporting frame in relation to said truss lumber supporting surface means being such that said power clamping device can be manually guided into engagement with all joints of a wooden truss being fabricated by the apparatus when the lumber forming the truss spans the entire length and width of the wheeled bed.

* * * * *